US006860387B2

(12) United States Patent
Chang

(10) Patent No.: US 6,860,387 B2
(45) Date of Patent: Mar. 1, 2005

(54) SELF-LIFTING APPARATUS FOR BOX COVER

(75) Inventor: Wei Yu Chang, Taipei (TW)

(73) Assignee: Shyh Ru Mettalic Industrial Corp., Taipei (TW)

( * ) Notice: Subject to any disclaimer, the term of this patent is extended or adjusted under 35 U.S.C. 154(b) by 66 days.

(21) Appl. No.: 10/202,845

(22) Filed: Jul. 26, 2002

(65) Prior Publication Data

US 2004/0016675 A1 Jan. 29, 2004

(51) Int. Cl.[7] ..... A45C 11/00

(52) U.S. Cl. ..... 206/214; 206/751; 220/829; 220/830; 16/295

(58) Field of Search ..... 206/214, 425, 206/751, 752, 754; 220/827, 829, 830, 264, FOR 193; 16/295, 306, 373

(56) References Cited

U.S. PATENT DOCUMENTS 790,578 A * 5/1905 Kirby ..... 206/425
2,442,873 A * 6/1948 Graham ..... 220/827
2,557,048 A * 6/1951 Haase ..... 220/830
2,682,969 A * 7/1954 Sunko ..... 220/843
3,438,152 A * 4/1969 Cadiou ..... 49/386
4,458,379 A * 7/1984 Shelton ..... 16/297
4,524,438 A * 6/1985 Einhaus ..... 369/75.1
4,590,692 A * 5/1986 Leonardi ..... 36/118.6
5,041,818 A * 8/1991 Liu ..... 361/681

FOREIGN PATENT DOCUMENTS

CH 438877 * 6/1967

* cited by examiner

*Primary Examiner*—David T. Fidei
(74) *Attorney, Agent, or Firm*—Troxell Law Office PLLC

(57) ABSTRACT

An improved self-lifting apparatus for a box cover including a bent bar locator on the box cover with both ends bended to accommodate an elastic component. The elastic component is provided with extended arms on both ends, one end pressing the bent bar and the other end being inserted into a hole of the box, thereby simplifying the production procedure and allowing box cover to be lifted automatically. With the elastic component, the bent bar is usable as a file holder in the box and the box can be used for a longer period of time.

3 Claims, 6 Drawing Sheets

SELF-LIFTING APPARATUS FOR BOX COVER

BACKGROUND OF THE INVENTION

1. Field of the Invention

The present invention relates to an improved self-lifting apparatus and, more particularly, to an improved self-lifting apparatus for box cover and is conveniently assembled, and allows box cover to be lifted automatically and can be used as file clip in the box.

2. Description of the Prior Art

As shown by FIG. 1, the conventional self-lifting apparatus is provided with a heated iron wire on the wrapping edge of its lower end to force both ends of the iron wire outside the box to be inserted into the holes on the box when the box is closed, and thus allows the flexibility of iron wire to lift the box cover as soon as the closed end of the box is opened.

The conventional self-lifting apparatus is useful for the non-complicated boxes, such as cashbox and pencil box, and is, however, inconvenient for the complicated products such as portable safe. Disadvantages are as illustrated as follows:

1. The conventional self-lifting apparatus is assembled in a fixed manner that requires both iron wire and wrapping edge to be installed in the box before the parts are assembled and, therefore, production becomes time-consuming and the apparatus can be broken easily. When installed in the safe made of hard materials, the conventional self-lifting apparatus can be used approximately five thousand times only.

2. The conventional self-lifting apparatus allows box cover to be lifted with its flexibility. To include file holders in the box, holed pieces have to be installed underneath the cover to allow the ⊓-shaped bars with outward-bended ends to penetrate through and, therefore, the production requires a few more steps and the costs of materials and labors increase as well.

SUMMARY OF THE INVENTION

To solve the problems related to the conventional self-lifting apparatus, the present invention is provided with an improved self-lifting apparatus comprising a ⊓-shaped bar provided on the box with both arms bended to accommodate elastic component. The elastic component is provided with extended arms on both ends, one end pressing the ⊓-shaped bar and the other end being inserted into the holes of box, and thus simplifies the production procedure, facilitates the assembly process, and allows the box cover to be lifted automatically. With the elastic component, the ⊓-shaped bar can be used as file clip in the box and the box cover can be used for a longer period of time.

Other advantages of the invention will be evident from the following detailed description when read in conjunction with the accompanying drawings that illustrate one preferred embodiment of the invention.

DETAILED DESCRIPTION OF THE PREFERRED EMBODIMENT

Figure 1A:
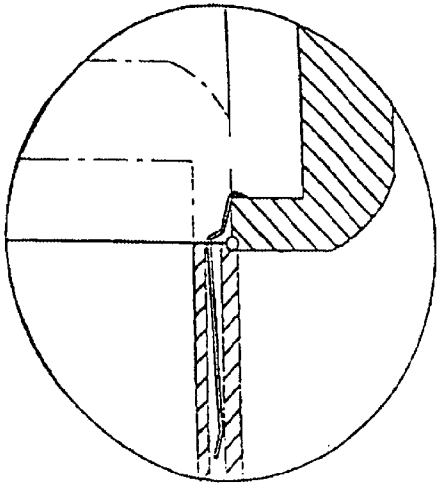
Fig.1A Prior Art
FIG. 1A is an enlarged view of area A in FIG. 1.
Figure 1:
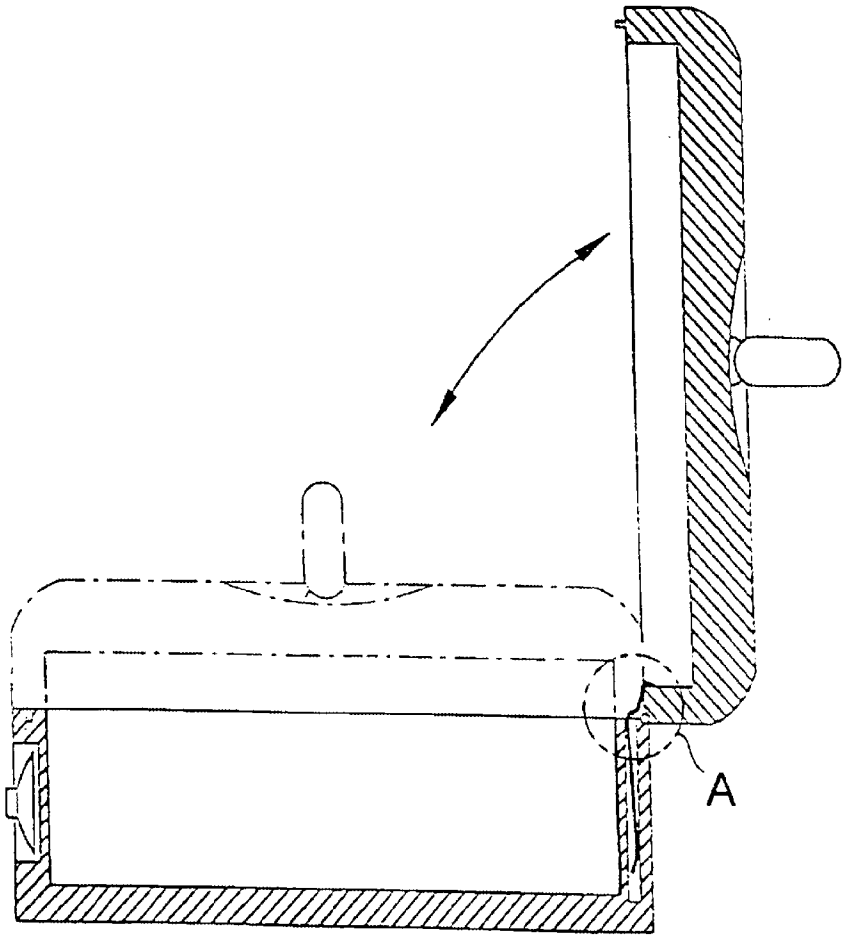
Fig.1 Prior Art
FIG. 1 is a side cross-sectional view showing the structure of a conventional self-lifting apparatus.
Figure 2:
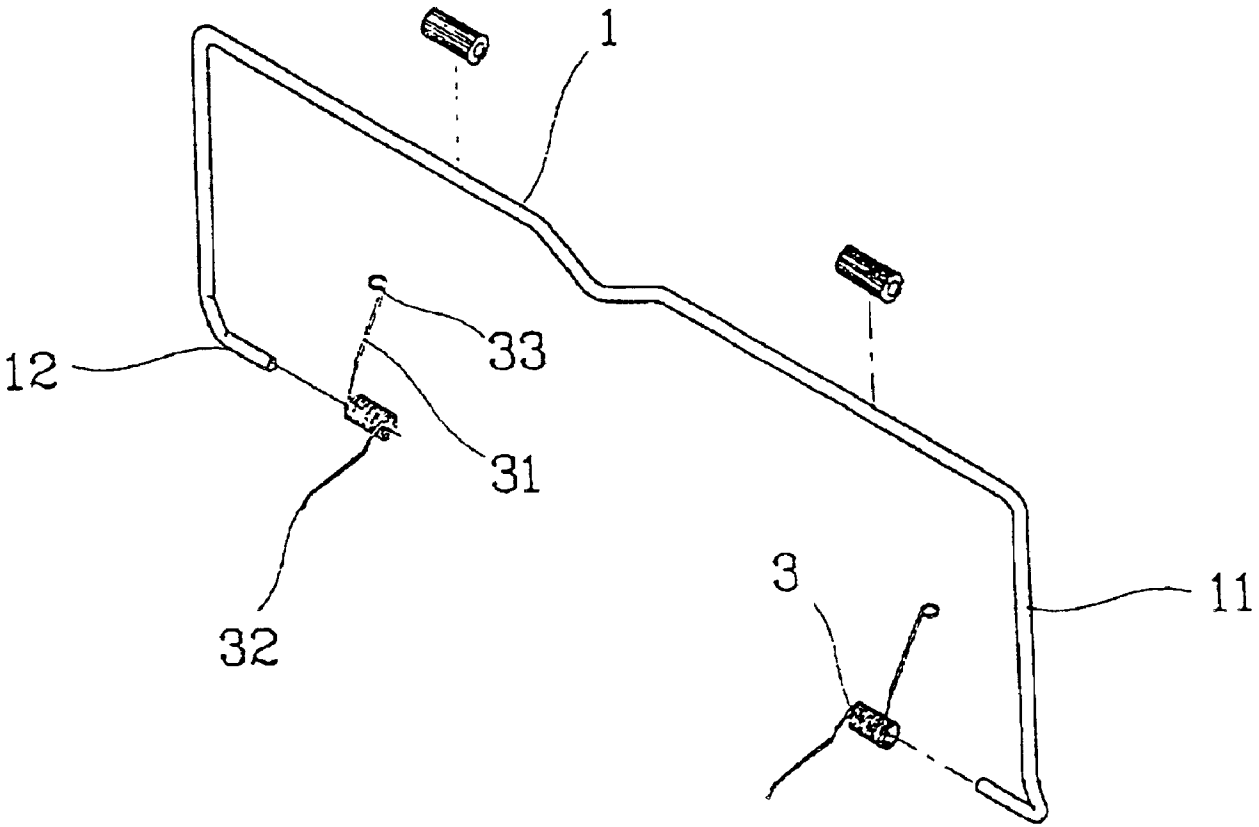
FIG. 2 is an exploded perspective view of the present invention.
Figure 3:
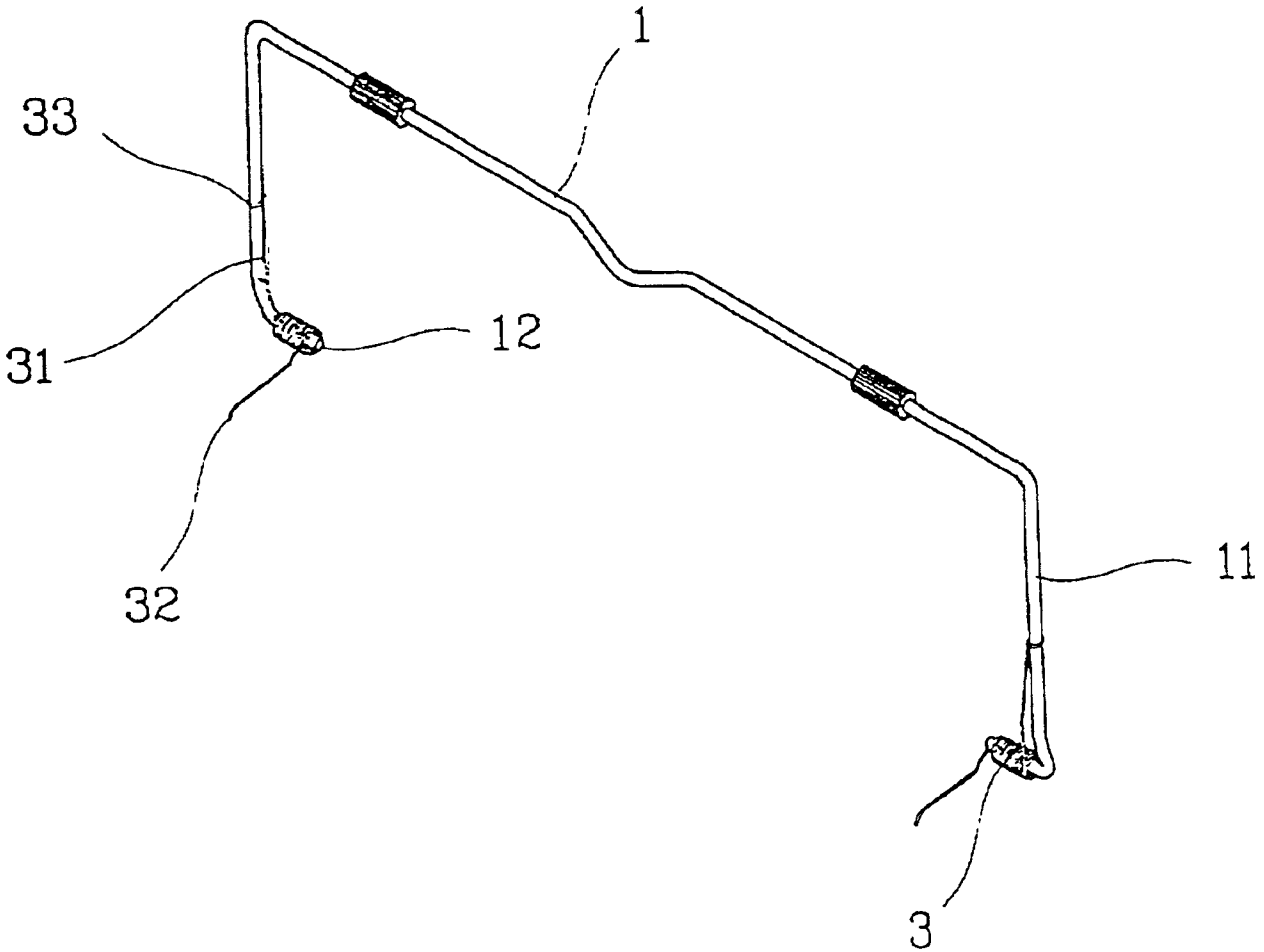
FIG. 3 is a perspective view of the present invention.
Figure 4:
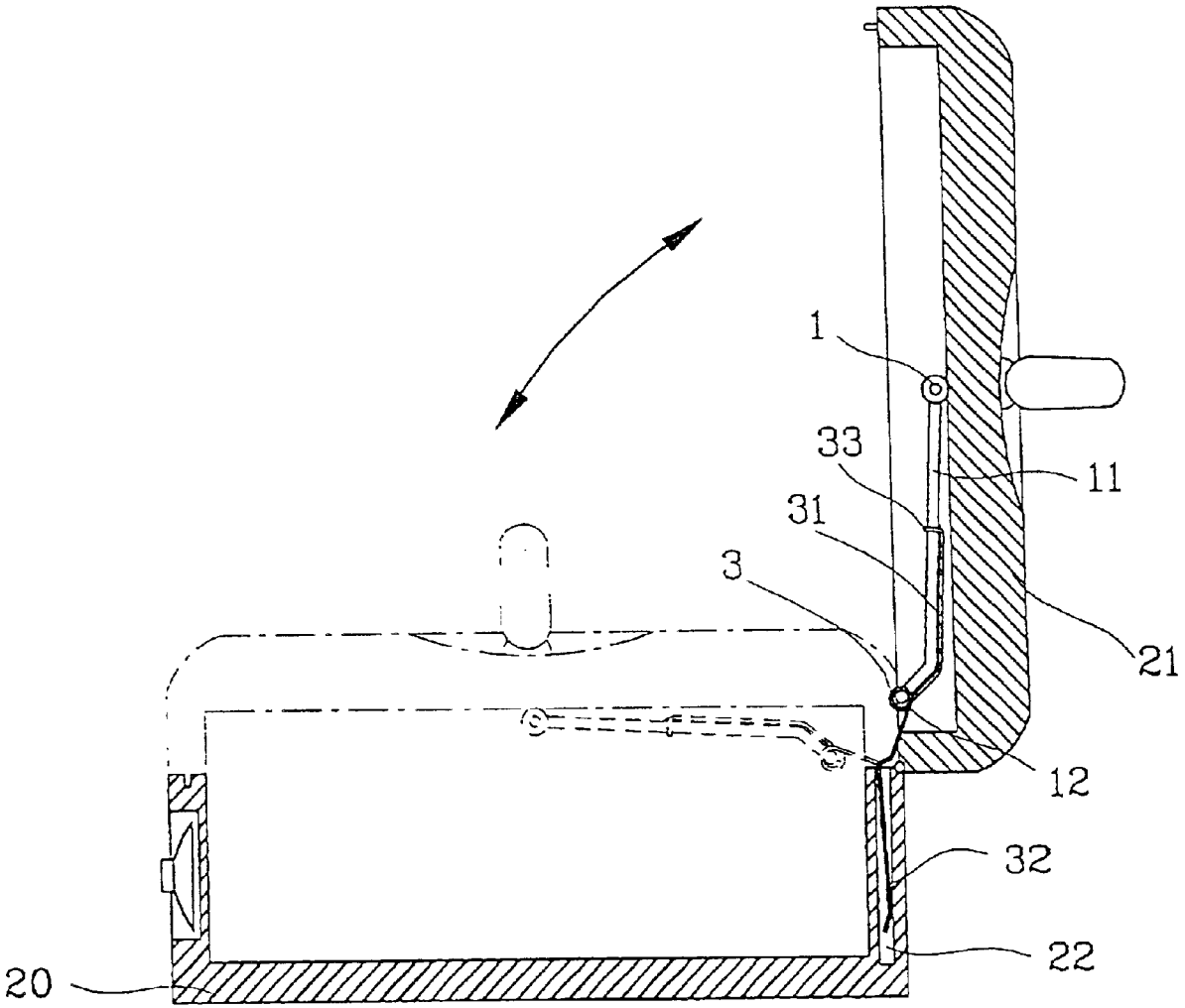
FIG. 4 is a side cross-sectional view showing the self-lifting motion of the present invention.

Referring to FIG. 2 through 4, the self-lifting apparatus of present invention comprises the components as follows:

a ⊓-shaped bar 1 provided on the box cover 21 with both arms 11 bended 12 to accommodate elastic component 3, and an elastic component 3 provided with extended arms 31 and 32 on both ends, one end pressing the ⊓-shaped bar's arm 11 and the other end inserting into the holes 22 of box 20.

The lower ends of the ⊓-shaped bar's both arms 11 bend inwards 12. The bending area 12 and both arms 11 align in "<" shape. The elastic component 3 is a spring pressing the extended arm 31 of the arms 11 and is provided with a bended ring 33.

As shown by FIG. 3 regarding the assembly process, the rings 33 of the elastic components 3 are placed around the bending area 12 on the lower end of ⊓-shaped bar 1 and moves along the <-shaped area until the central area of both arms 11. At this time the coil of elastic component 3 wraps the bending area 12, and thus forms the box cover 21. No wrapping edge, wire or holed piece is needed. The loose leaf provided inside the box cover 21 forces the other extended arm 32 of the elastic component 3 to be inserted into the hole 22 of the box 20, thereby connecting all parts firmly and simplifying the production procedure.

Figure 5:
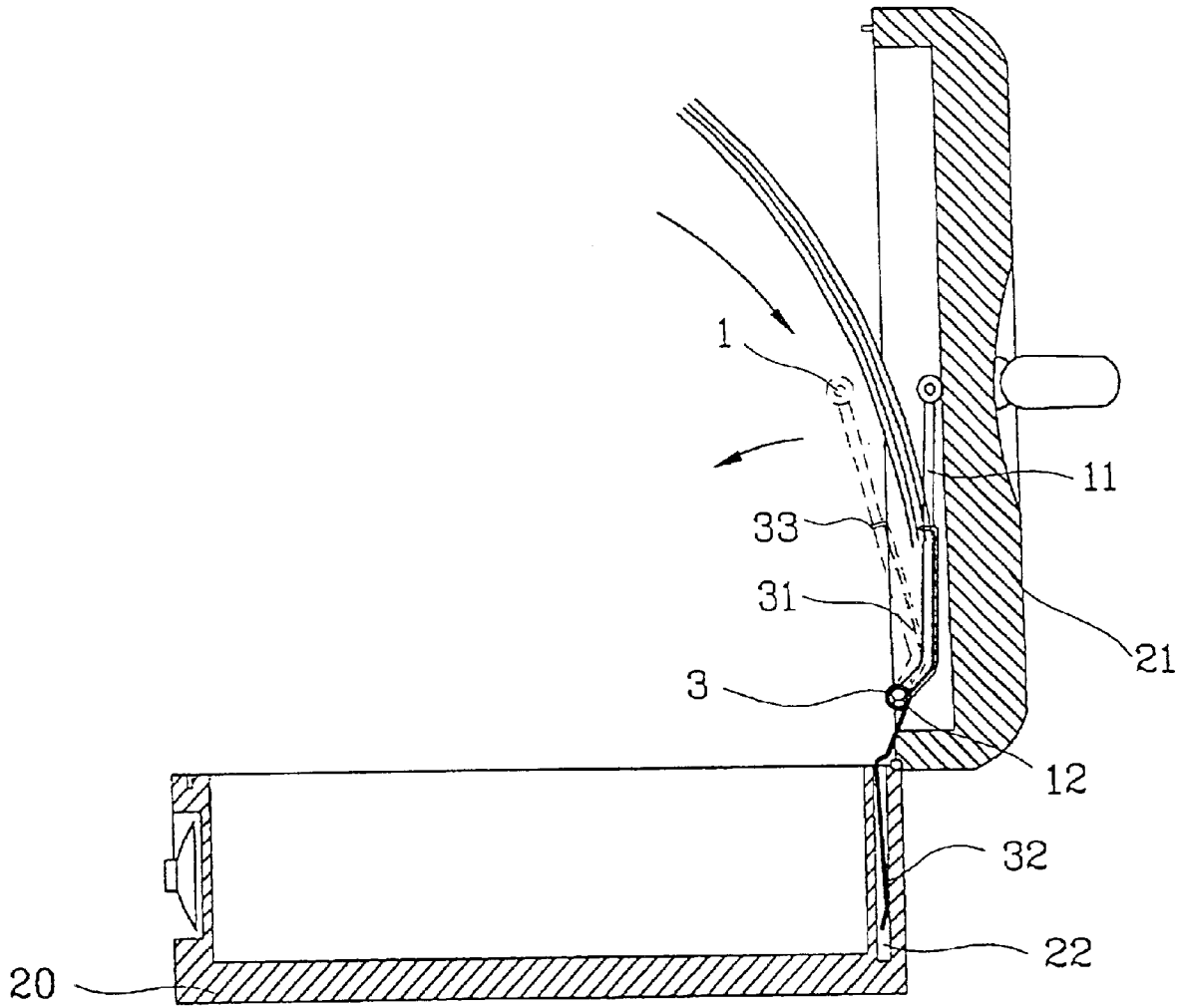
FIG. 5 is a side cross-sectional view showing the present invention being used as file folder.

As shown by FIG. 4, as soon as the locking end of the box 20 is opened, the elastic component 3 is twisted and stretches to open the box cover 21. As shown by FIG. 5, with the elastic component 3, the ⊓-shaped bar 1 can be used as file clip in the box.

Figure 6:
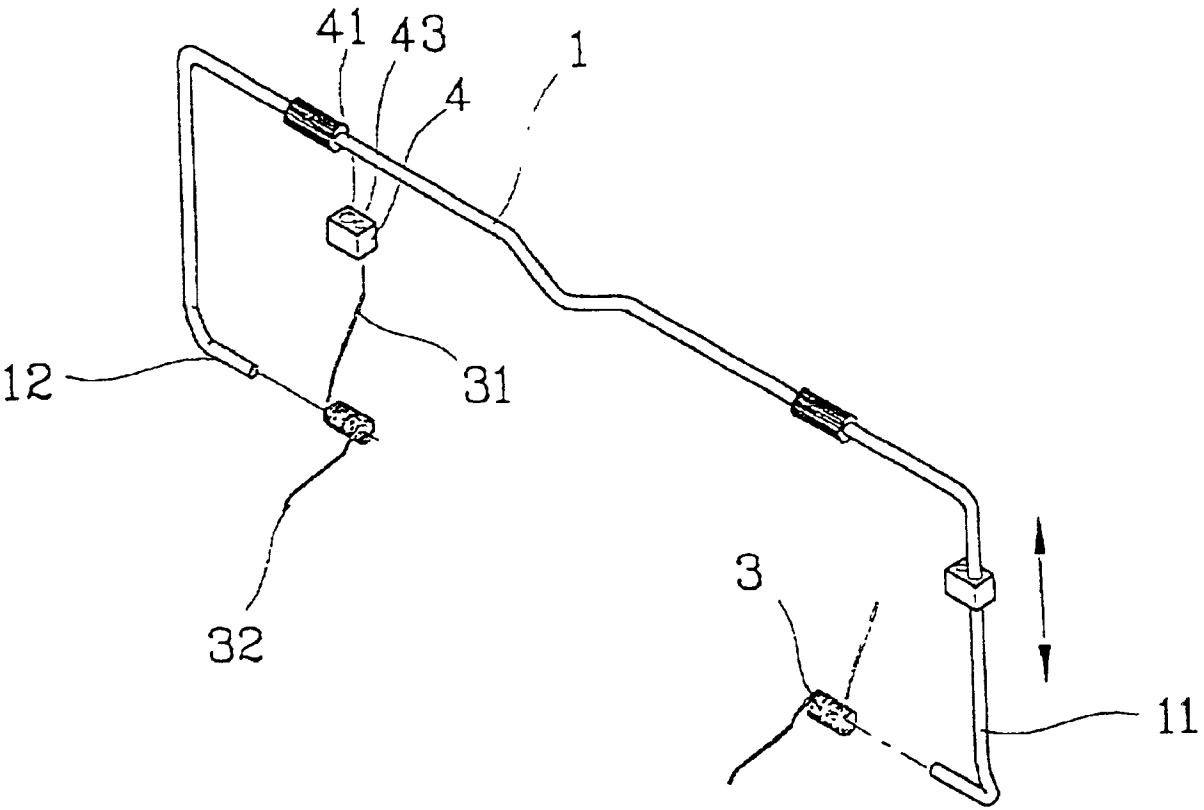
FIG. 6 is an exploded perspective view showing another motion of the present invention.

As shown by FIG. 6, the ring 33 provided in the extended arm 31 of the elastic component 3 can be removed to facilitate the assembly process and replaced by a loose brace 4 to be provided in the arms 11. The loose brace 4 can be made either singly holed or "8"-shaped holed 41 and 43 to reduce the time needed for bending when the elastic component 3 is installed. Just to place the coil around the bending area 12 and move the loose brace 4 to fix the ring.

The self-lifting apparatus of present invention simplifies the production procedure and can be used as file holder and, most importantly, can be used at least ten thousand times, thereby upgrading quality and durability of products.

Having thus described the present invention, what the inventor claims as new and desire to be secured by Letters Patent of the United States include:

1. A self-lifting apparatus for a cover of a box comprising:

a) a bent bar having two bar arms, each of the two bar arms having a bent portion; and b) two elastic components, each elastic component located on one bent portion of each of the two bar arms and having first and second arms, each first arm connected to one of the two bar arms and each second arm being inserted into a hole in the box, wherein the two elastic components press the bent bar against the cover of the box.

2. The self-lifting apparatus according to claim 1, wherein each bent portion of the two bar arms is bent inwardly, each first arm of the two elastic components includes a bent ring connecting the first arm to one of the two bar arms.

3. The self-lifting apparatus according to claim 1, further comprising two loose braces, each bent portion of the two bar arms is bent inwardly, each of the two loose braces connecting one first arm of the two elastic components to one of the two bar arms.

* * * * *